United States Patent [19]

Fender

[11] Patent Number: 4,550,445

[45] Date of Patent: Nov. 5, 1985

[54] VENTILATED ATHLETIC CAP

[76] Inventor: David A. Fender, 384 Pheasant Run Rd., Harleysville, Pa. 19438

[21] Appl. No.: 607,265

[22] Filed: May 4, 1984

[51] Int. Cl.[4] ..... A42C 5/04

[52] U.S. Cl. ..... 2/181.6; 2/182.8

[58] Field of Search ..... 2/410, 425, 171.3, 182.8, 2/184.5, 195, 182.6, 181.6

[56] References Cited

U.S. PATENT DOCUMENTS

| | | | |
|---|---|---|---|
| 563,175 | 6/1896 | Hirschberg | 2/182.6 |
| 888,902 | 5/1908 | Jaillet et al. | 2/181.8 X |
| 1,771,544 | 7/1930 | McKisson | 2/182.8 X |
| 2,286,202 | 6/1942 | Fischer | 2/181.6 |
| 3,925,821 | 12/1975 | Lewicki | 2/171.3 X |
| 4,115,874 | 9/1978 | Hasegawa | 2/425 |
| 4,434,514 | 3/1984 | Sundahl et al. | 2/181.6 X |

*Primary Examiner*—Louis K. Rimrodt

*Attorney, Agent, or Firm*—Joseph W. Molasky & Assocs.

[57] ABSTRACT

A hat or cap comprising an adjustable headband, a semi-rigid visor attached to said headband and extending along the front and both sides of the cap, and a canopy attached to the outer edges of said visor. The canopy is made of formed cloth or semi-rigid material so as to maintain its shape and keep a spaced relation between the cap and the head of the wearer. The canopy further contains air vents in the front and rear so as to permit the unrestricted flow of air about the head of the wearer.

6 Claims, 5 Drawing Figures

VENTILATED ATHLETIC CAP

BACKGROUND OF THE INVENTION

This invention relates to a hat or cap which is constructed not only to permit the circulation of air about the wearer's head, but to promote the flow of cooling air, especially during exercise.

Earlier patented head gear have attempted to provide sun protection while at the same time permitting the flow of air by means of various holes and perforations. Such configurations have nonetheless resulted in a comparatively restricted air space about the wearer's head.

The present invention employs a novel construction that provides effective sun protection while at the same time taking advantage of natural air currents especially while the wearer is in motion. The present design permits a completely unrestricted air flow, thereby achieving the maximum cooling effect for the benefit of the wearer.

BRIEF DESCRIPTION OF THE DRAWINGS

The features and objects of the invention will be better understood from the following detailed description of the embodiment illustrated in the accompanying drawings in which.

SUMMARY OF THE INVENTION

A hat or cap constructed in accordance with the present invention utilizes a headband to which is attached a semi-rigid visor. The visor is fashioned in a manner to provide protection to the wearer's nose and face, and in addition, it extends backwardly along each side so as to nearly encircle the wearer's head. To the outer edge of the visor is attached a canopy of formed cloth or other semi-rigid material with air vents formed in the front and rear of the canopy to permit an unrestricted flow of air about the wearer's head especially while the wearer is in motion. The combination of semi-rigid visor and canopy maintains the shape of the cap, and only the headband is in contact with the wearer's heed. An additional feature of the device is the use of a radiation reflecting (light) outer material and a radiation absorbing (dark) inner material. This combination of colored materials deflects nearly all of the sun's radiation by reflection, and absorbs most radiant body heat for transfer to the air by either convection or radiation. The above-recited combination of features provides a superior device for cooling the head of the wearer during athletic activity or during exposure to the sun.

DESCRIPTION OF THE PREFERRED EMBODIMENT

Figure 1:
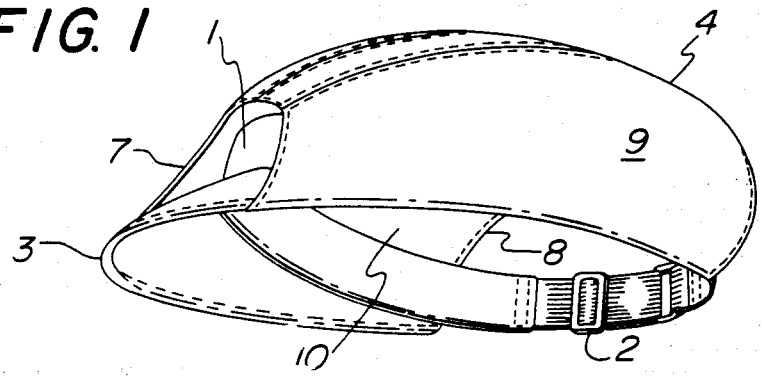
FIG. 1 shows the invention as viewed from the side, slightly below and to the front.
Figure 2:
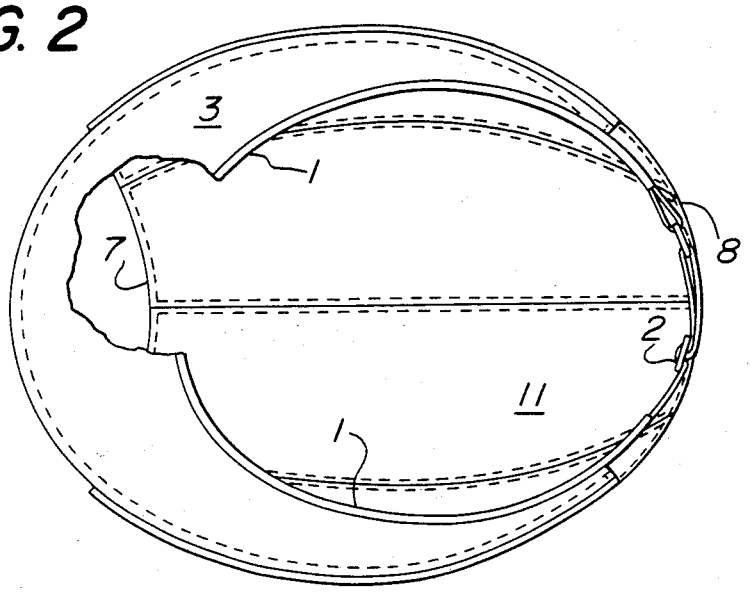
FIG. 2 is a bottom plan view with cutaway.
Figure 3:
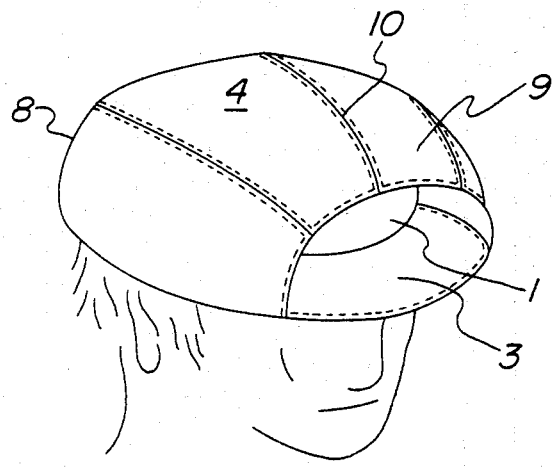
FIG. 3 is an oblique view as taken from the front and above.
Figure 4:
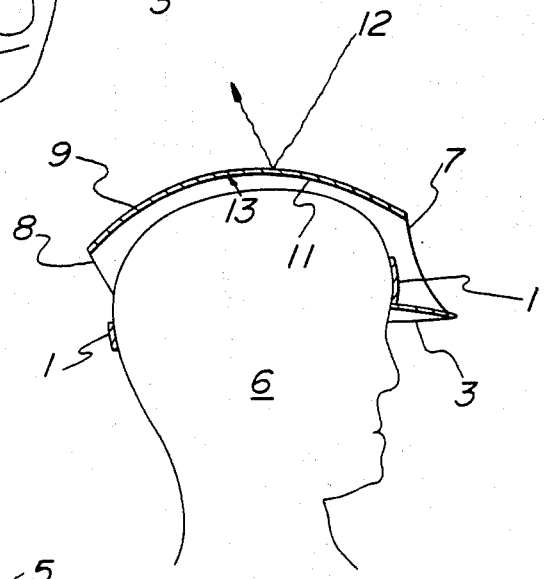
FIG. 4 is a longitudinal section of the cap and wearer.

A form of cap embodying the invention is illustrated in FIGS. 1 through 5 and includes a one-piece headband 1 of a suitable pliable and moisture-permeable material, with a tightness-adjusting means 2 to which is attached a semi-rigid visor 3 for protection of the eyes and face from the sun. The visor is formed from a single piece of semi-rigid material and covered with fabric. The visor is shaped so as to incline downwardly from the headband, and in addition it extends backwardly in a arcuate manner along each side so as to nearly encircle the wearer's head as shown in FIG. 2. To the outer edge of the visor is attached a canopy 4 of formed cloth elements or other semi-rigid materials with a semicircular air vent 7 formed in the front of the canopy and a similar air vent 8 formed in the rear of the canopy to permit an unrestricted flow of air about the wearer's head. The canopy 4 as shown in FIG. 3 may be formed by conventional means from a number of fabric elements 9 having arcuate edges 10 stitched or otherwise seamed together so as to result in a canopy in the shape of a shell or hemisphere. A longitudinal section of the cap shown on the wearer's head in FIG. 4 illustrates the unrestricted ventilating air flow 5 between the head 6 and the canopy 4.

Figure 5:
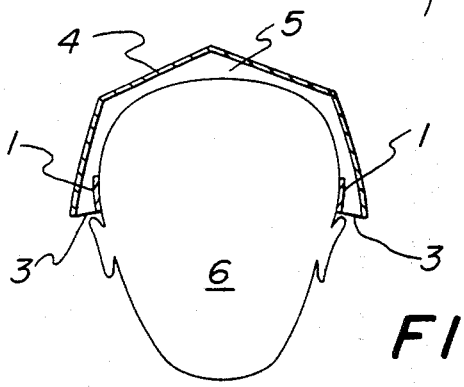
FIG. 5 is a cross-section of the cap and wearer.

An additional feature of the device FIG. 4 is the use of a radiation reflecting (light) outer material 9, and a radiation absorbing (dark) inner material 11. This composition deflects nearly all of the sun radiation 12, by reflection and absorbs most of the radiant body heat 13 for transfer to the air by either convection or radiation. The two-ply construction of stitched or laminated materials to form the elements of the canopy results in an improved ability to maintain the desired shape of the canopy. A cross-section of the cap on the wearer's head FIG. 5 shows the attachment of the canopy 4 to the outer edges of the visor 3 and further illustrates the unrestricted air flow passageway 5 about the wearer's head.

I claim:

1. A hat or cap comprising:

a headband of pliable, moisture-permeable material with tightness adjusting means;

a visor attached to said headband, said visor being formed from a semi-rigid material and shaped so as to incline downwardly from said headband, and in addition, to extend backwardly in an arcuate manner along each side so as to nearly encircle the head of the wearer;

a canopy of formed cloth elements or other semi-rigid materials attached to the outer edges of said visor, said canopy being formed from a plurality of elements having arcuate edges stitched or otherwise seamed together, said canopy further comprising a radiation reflecting (light) outer material, and a radiation absorbing (dark) inner material, and said canopy further having a semi-circular air vent in the front and a similar vent in the rear.

2. The cap according to claim 1 wherein said headband is of one-piece construction and encircles the wearer's head.

3. The cap according to claim 1 wherein said canopy is in a spaced relationship to the wearer's head.

4. The cap according to claim 3 wherein the spaced relationship between said canopy and the wearer's head consists of a passageway in which air is allowed to flow unrestrictedly to provide a cooling effect.

5. The cap according to claim 1 wherein the front vent is an arcuate opening which is formed by the canopy and the visor to which it is attached.

6. The cap according to claim 1 wherein the rear vent is an arcuate opening which is formed by the canopy and the headband to which it is attached.

* * * * *